US008723435B2

(12) United States Patent
Zhang et al.

(10) Patent No.: US 8,723,435 B2
(45) Date of Patent: May 13, 2014

(54) ILLUMINATION APPARATUS, ELECTRONIC BALLAST THEREIN AND METHOD FOR PROTECTING THE SAME

(75) Inventors: Wei-Qiang Zhang, Shanghai (CN); Jian-Ping Ying, Shanghai (CN)

(73) Assignee: Delta Electronics (Shanghai) Co., Ltd., Shanghai (CN)

( * ) Notice: Subject to any disclaimer, the term of this patent is extended or adjusted under 35 U.S.C. 154(b) by 299 days.

(21) Appl. No.: 13/241,220

(22) Filed: Sep. 23, 2011

(65) Prior Publication Data

US 2013/0026952 A1 Jan. 31, 2013

(30) Foreign Application Priority Data

Jul. 27, 2011 (CN) ..... 2011 1 0211535

(51) Int. Cl.
*H05B 37/02* (2006.01)

(52) U.S. Cl.
USPC ..... 315/209 R; 315/224; 315/311

(58) Field of Classification Search
USPC ..... 315/209 R, 224, 225, 276, 291, 311
See application file for complete search history.

(56) References Cited

U.S. PATENT DOCUMENTS

| | | | | |
|---|---|---|---|---|
| 5,485,060 | A * | 1/1996 | Canova | 315/209 R |
| 5,801,491 | A * | 9/1998 | Canova | 315/224 |
| 6,057,652 | A * | 5/2000 | Chen et al. | 315/307 |
| 7,816,872 | B2 * | 10/2010 | Nerone et al. | 315/224 |
| 2004/0113567 | A1 | 6/2004 | Yamauchi et al. | |
| 2008/0211423 | A1 * | 9/2008 | Shinmen et al. | 315/259 |

FOREIGN PATENT DOCUMENTS

| | | | |
|---|---|---|---|
| CN | 1175324 | A | 3/1998 |
| CN | 1228244 | A | 9/1999 |
| CN | 1342340 | A | 3/2002 |
| CN | 1719711 | A | 1/2006 |

* cited by examiner

*Primary Examiner* — Tung X Le
(74) *Attorney, Agent, or Firm* — CKC & Partners Co., Ltd.

(57) ABSTRACT

An electronic ballast includes an inverter circuit, a variable inductor unit and a control circuit. The variable inductor unit is electrically coupled between the inverter circuit and an illumination device. The control circuit controls the variable inductor unit according to an operation mode of the inverter circuit such that an equivalent inductance of the variable inductor unit has a variation fed back to the inverter circuit, to further change the operation mode of the inverter circuit. An illumination apparatus and a method for protecting the electronic ballast are also disclosed.

19 Claims, 6 Drawing Sheets

ILLUMINATION APPARATUS, ELECTRONIC BALLAST THEREIN AND METHOD FOR PROTECTING THE SAME

RELATED APPLICATIONS

This application claims priority to Chinese Patent Application Serial Number 201110211535.X, filed Jul. 27, 2011, which is herein incorporated by reference.

BACKGROUND

1. Technical Field

The present disclosure relates to an activation circuit. More particularly, the present disclosure relates to an electronic ballast used in an illumination apparatus.

2. Description of Related Art

With rapid development of technology, illumination has become a primary demand in daily lives of human, in which the use of a gas discharge lamp has become the mainstream for illumination system because the gas discharge lamp has high light-emitting efficiency, long lifespan, capability of emitting light of multi-colors, etc.

Typically, the gas discharge lamp needs a ballast to limit the current flowing through the lamp, and in addition, to activate the gas discharge lamp. In practice, operations of activating the gas discharge lamp and limiting the current thereof can be implemented by an electronic ballast.

However, when the gas discharge lamp operates with the electronic ballast, operations of circuit(s) in the electronic ballast may be affected, thus causing damages of devices, due to a possible change of the current flowing toward the gas discharge lamp. Therefore, it is necessary to provide a protection mechanism to avoid situations that the circuits or devices may be damaged.

SUMMARY

The present disclosure is to provide a protection mechanism so as to prevent devices of an electronic ballast from being damaged.

An aspect of the present invention is to provide an electronic ballast. The electronic ballast comprises an inverter circuit, a variable inductor unit and a control circuit. The variable inductor unit is electrically coupled between the inverter circuit and an illumination device. The control circuit is configured to control the variable inductor unit according to an operation mode of the inverter circuit such that an equivalent inductance of the variable inductor unit has a variation fed back to the inverter circuit to switch the operation mode of the inverter circuit.

In accordance with one embodiment of the present invention, the control circuit is configured to receive a sensing signal corresponding to current variations in the inverter circuit and to control the variable inductor unit according to the sensing signal.

In accordance with another embodiment of the present invention, the electronic ballast further comprises a sensing circuit configured to detect the current variations in the inverter circuit to generate the sensing signal and to transmit the sensing signal to the control circuit.

In accordance with yet another embodiment of the present invention, the sensing circuit comprises a sensing resistor for detecting the current variations in the inverter circuit to generate a sensing voltage signal transmitted to the control circuit.

In accordance with still another embodiment of the present invention, the sensing circuit comprises a current sensing device for detecting the current variations in the inverter circuit to generate a sensing current signal transmitted to the control circuit.

Another aspect of the present invention is to provide an electronic ballast. The electronic ballast includes an inverter circuit, a variable inductor unit and a control circuit. The inverter circuit comprises a first switch device and a second switch device, and the first switch device and the second switch device are coupled at an operation node. The variable inductor unit has one end electrically coupled to the operation node and has the other end electrically coupled to an illumination device. The control circuit is electrically coupled to the variable inductor unit and configured to regulate the variable inductor unit according to a sensing signal when the inverter circuit operates under a capacitive mode of operation, such that an equivalent inductance of the variable inductor unit increases and the inverter circuit switches to operate under an inductive mode of operation.

In accordance with one embodiment of the present invention, the electronic ballast further comprises a sensing circuit electrically coupled to the inverter circuit and configured to transmit the sensing signal to the control circuit when the inverter circuit operates under the capacitive mode of operation.

In accordance with another embodiment of the present invention, when the inverter circuit operates under the capacitive mode of operation, the sensing circuit detects a current flowing through the second switch device in the inverter circuit to generate the sensing signal.

In accordance with yet another embodiment of the present invention, the sensing circuit comprises a sensing resistor having one end electrically coupled to the second switch device and the control circuit and having the other end electrically coupled to a relatively low level voltage.

In accordance with still another embodiment of the present invention, the sensing circuit comprises a current sensing device electrically coupled between the second switch device and the control circuit.

Yet another aspect of the present invention is to provide an illumination apparatus. The illumination apparatus comprises an illumination device and an electronic ballast. The electronic ballast is electrically coupled to the illumination device and comprises an inverter circuit, a variable inductor unit and a control circuit. The variable inductor unit is electrically coupled between the inverter circuit and the illumination device. The control circuit is configured to regulate the variable inductor unit when the inverter circuit operates under a capacitive mode of operation, such that an equivalent inductance of the variable inductor unit increases and the inverter circuit switches to operate under an inductive mode of operation.

In accordance with one embodiment of the present invention, the inverter circuit further comprises a first switch device and a second switch device, and the first switch device and the second switch device are electrically coupled to the variable inductor unit.

In accordance with another embodiment of the present invention, the illumination apparatus further comprises a sensing circuit coupled in cascade with the first switch device and the second switch device and configured to detect a current flowing through the second switch device in the inverter circuit to generate a sensing signal. The control circuit is configured to regulate the variable inductor unit according to the sensing signal.

In accordance with yet another embodiment of the present invention, the illumination apparatus further comprises a sensing resistor coupled in cascade with the first switch device and the second switch device and configured to transmit a sensing voltage signal for driving the control circuit to regulate the variable inductor unit when the inverter circuit operates under the capacitive mode of operation.

In accordance with still another embodiment of the present invention, the illumination apparatus further comprises a current sensing device coupled in cascade with the first switch device and the second switch device and configured to transmit a sensing current signal for driving the control circuit to regulate the variable inductor unit when the inverter circuit operates under the capacitive mode of operation.

Still yet another aspect of the present invention is to provide a method for protecting an electronic ballast. The method comprises operations mentioned below. An operation mode of an inverter circuit is first detected. A sensing signal is generated when the inverter circuit operates under a capacitive mode of operation. A variable inductor unit is controlled according to the sensing signal such that an equivalent inductance of the variable inductor unit has a variation. The inverter circuit switches to operate under an inductive mode of operation according to the variation of the equivalent inductance of the variable inductor unit.

In accordance with one embodiment of the present invention, the operation of generating the sensing signal further comprises an operation of detecting a current flowing through a switch device in the inverter circuit to generate the sensing signal when the inverter circuit operates under the capacitive mode of operation.

In accordance with another embodiment of the present invention, the operation of generating the sensing signal further comprises an operation of detecting current variations in the inverter circuit to generate a sensing voltage signal or a sensing current signal when the inverter circuit operates under the capacitive mode of operation.

In accordance with yet another embodiment of the present invention, the operation of controlling the variable inductor unit further comprises regulating a current flowing through the variable inductor unit to increase the equivalent inductance of the variable inductor unit.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiments, with reference to the accompanying drawings as follows.

DESCRIPTION OF THE EMBODIMENTS

In the following description, several specific details are presented to provide a thorough understanding of the embodiments of the present invention. One skilled in the relevant art will recognize, however, that the present invention can be practiced without one or more of the specific details, or in combination with or with other components, etc. In other instances, well-known implementations or operations are not shown or described in detail to avoid obscuring aspects of various embodiments of the present invention.

The terms used in this specification generally have their ordinary meanings in the art and in the specific context where each term is used. The use of examples anywhere in this specification, including examples of any terms discussed herein, is illustrative only, and in no way limits the scope and meaning of the invention or of any exemplified term. Likewise, the present invention is not limited to various embodiments given in this specification.

As used herein, the terms "comprising," "including," "having," "containing," "involving," and the like are to be understood to be open-ended, i.e., to mean including but not limited to.

Reference throughout the specification to "one embodiment" or "an embodiment" means that a particular feature, structure, implementation, or characteristic described in connection with the embodiment is included in at least one embodiment of the present invention. Thus, uses of the phrases "in one embodiment" or "in an embodiment" in various places throughout the specification are not necessarily all referring to the same embodiment. Furthermore, the particular features, structures, implementation, or characteristics may be combined in any suitable manner in one or more embodiments.

The embodiments of the present invention described below disclose an illumination apparatus and an electronic ballast therein so as to avoid situations that circuit(s) or device(s) may be burned out or damaged.

Figure 1:
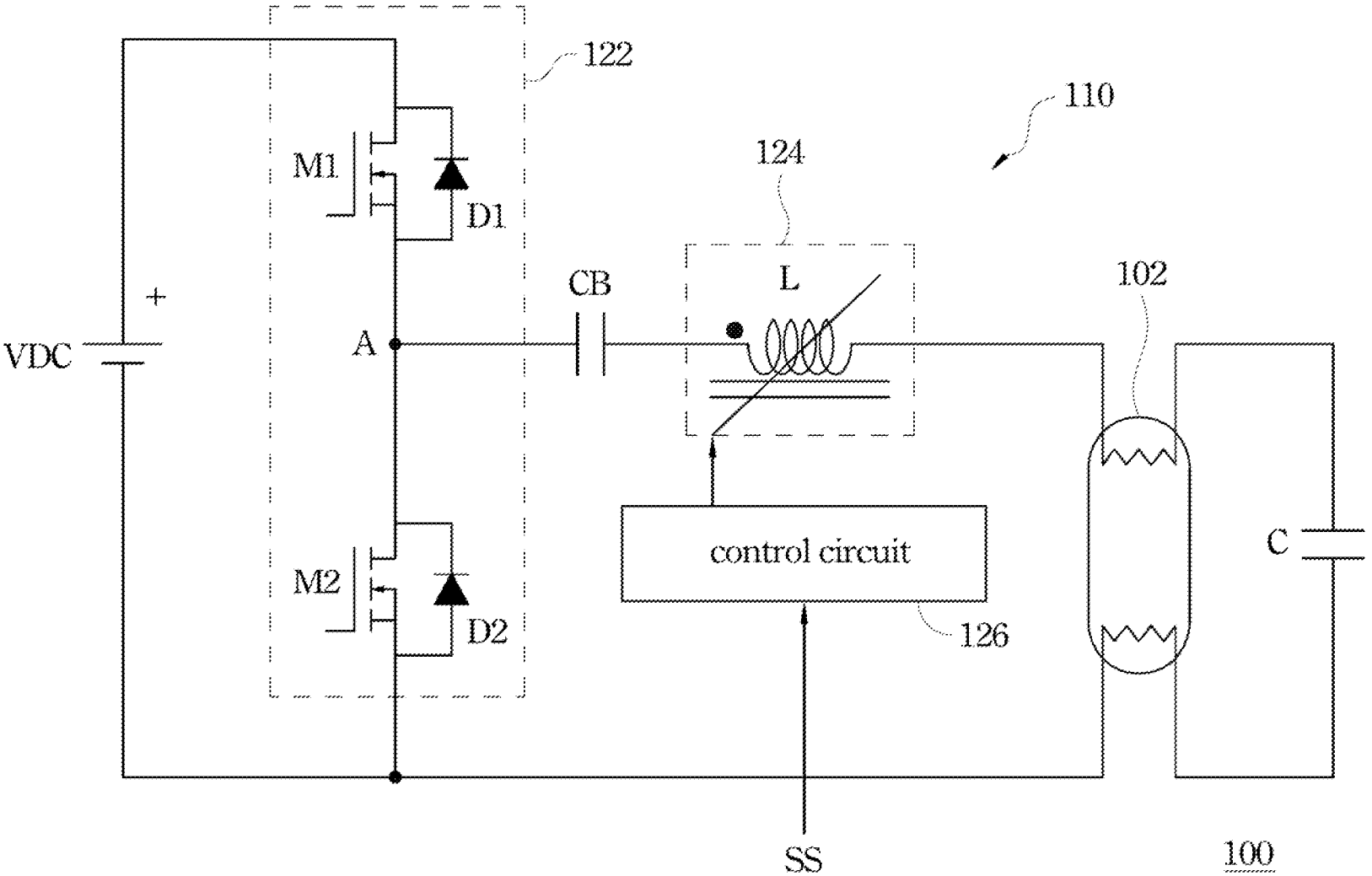
FIG. 1 is a circuit diagram of an illumination apparatus according to one embodiment of the present invention.

FIG. 1 is a circuit diagram of an illumination apparatus according to one embodiment of the present invention. The illumination apparatus 100 includes an illumination device 102 and an electronic ballast 110, in which the electronic ballast 110 is electrically coupled to the illumination device 102 and configured to activate the illumination device 102 (e.g., to power the illumination device 102). In practice, the illumination device 102 can be implemented by a gas discharge lamp, a fluorescent lamp or the like.

The electronic ballast 110 includes an inverter circuit 122, a variable inductor unit 124 and a control circuit 126, in which the variable inductor unit 124 is electrically coupled between the inverter circuit 122 and the illumination device 102, and the control circuit 126 is electrically coupled to the variable inductor unit 124 so as to control or regulate the variable inductor unit 124.

Generally, the control circuit 126 controls the variable inductor unit 124 according to an operation mode of the inverter circuit 122 such that an equivalent inductance of the variable inductor unit 124 has a variation fed back to the inverter circuit 122, to further switch the operation mode of the inverter circuit 122.

In one embodiment, the control circuit 126 is configured to receive a sensing signal SS corresponding to the operation mode of the inverter circuit 122 or current variations in the inverter circuit 122, such that the control circuit 126 controls the variable inductor unit 124 according to the sensing signal SS.

In the present embodiment, the inverter circuit 122 may be a half-bridge inverter circuit which further includes two switch devices M1 and M2, in which the switch devices M1 and M2 are electrically coupled to an operation node A (i.e., output of the inverter circuit 122). Moreover, one end of the variable inductor unit 124 is electrically coupled to the operation node A, for example, through a capacitor CB, and the other end of the variable inductor unit 124 is electrically coupled to the illumination device 102. However, the inverter circuit 122 also may be a full-bridge inverter circuit or other type of inverter circuit and is not limited to the half-bridge inverter circuit mentioned above.

In practice, the switch devices M1 and M2 may be implemented by field-effect transistors (FET), and the variable inductor unit 124 may include a variable inductor L that can be a voltage-controlled inductor or a current-controlled inductor, in which an equivalent inductance of the inductor L is regulated by varying the voltage or current therein. The number of the variable inductor L in the variable inductor unit 124 is not limited to one, and persons of ordinary skill in the art can utilize a particular amount of variable inductors according to actual requirements within the spirit and scope of the appended claims.

As illustrated in FIG. 1, when the switch device M1 is turned on and the switch device M2 is turned off, the generated current flows through the output of the inverter circuit 122 (i.e., the operation node A), the capacitor CB and the variable inductor L toward the illumination device 102, so as to provide power for the illumination device 102. Thereafter, an equivalent impedance of the illumination device 102 relative to the electronic ballast 110 has a variation, resulting in that the current flowing toward the illumination device 102 may change (e.g., the current flowing back to the inverter circuit 122), such that the inverter circuit 122 operates under a "capacitive mode of operation." As a result, when the switch device M1 is turned off and the switch device M2 is turned on, there may be current flowing through the switch device M2 and a parasitical diode D1 in the switch device M1 at the same time, causing a phenomenon of "direct short circuit" and that the switch device M1 and the switch device M2 may be burned out.

For at least improving the foregoing situation, in the foregoing embodiments of the present invention, when the inverter circuit 122 operates under the capacitive mode of operation, the control circuit 126 regulates the variable inductor unit 124 according to the sensing signal SS, such that the equivalent inductance of the variable inductor unit 124 increases and the inverter circuit 122 switches to operate under an "inductive mode of operation".

Figure 2:
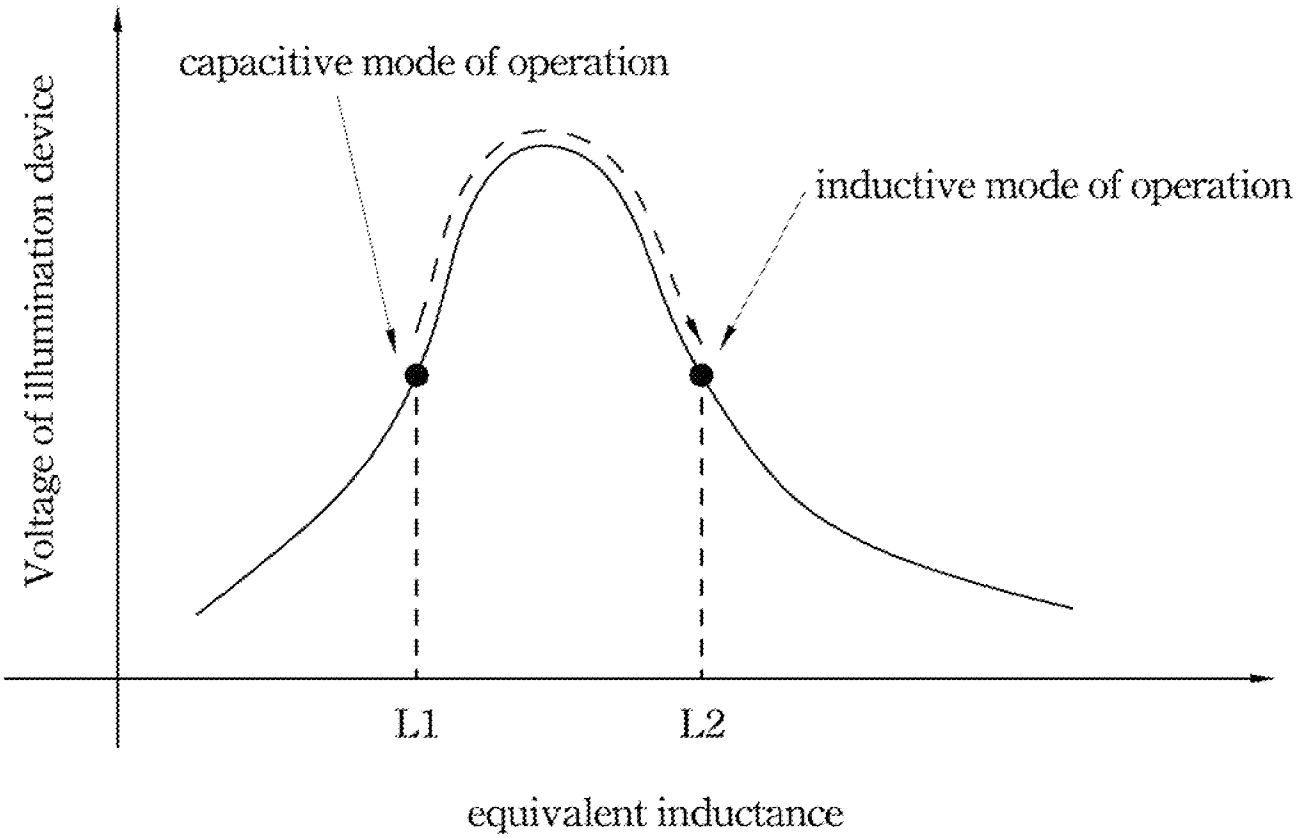
FIG. 2 is a diagram of switching operation mode of an inverter circuit based on the equivalent inductance according to one embodiment of the present invention.

For example, as illustrated in FIG. 2, when the inverter circuit 122 operates under the capacitive mode of operation, the equivalent inductance of the variable inductor unit 124 is L1. When the variable inductor unit 124 is regulated such that the equivalent inductance of the variable inductor unit 124 increases to be L2, the inverter circuit 122 can operate under the inductive mode of operation.

Notably, the condition that the inverter circuit 122 operates under the capacitive or inductive mode of operation may be referred to as that the inverter circuit 122 actually operates under the capacitive or inductive mode of operation, and also may be referred to as that the inverter circuit 122 actually operates near the capacitive or inductive mode of operation.

Furthermore, the condition that the inverter circuit 122 operates under the capacitive mode of operation is mainly referred to as that the current flowing through the variable inductor unit 124 leads the voltage across the switch device M2. The condition that the inverter circuit 122 operates near the capacitive mode of operation is mainly referred to as that the current flowing through the variable inductor unit 124 is close to but does not yet lead the voltage across the switch device M2. For example, given a resonant frequency of about 50 KHz corresponding to the variable inductor unit 124. The condition that the inverter circuit 122 operates near the capacitive mode of operation is mainly referred to as that the current flowing through the variable inductor unit 124 lags behind but is within about 1 microsecond of the voltage across the switch device M2.

On the other hand, the condition that the inverter circuit 122 operates under the inductive mode of operation is mainly referred to as that the voltage across the switch device M2 which is turned off leads the current flowing through the variable inductor unit 124.

Figure 3:
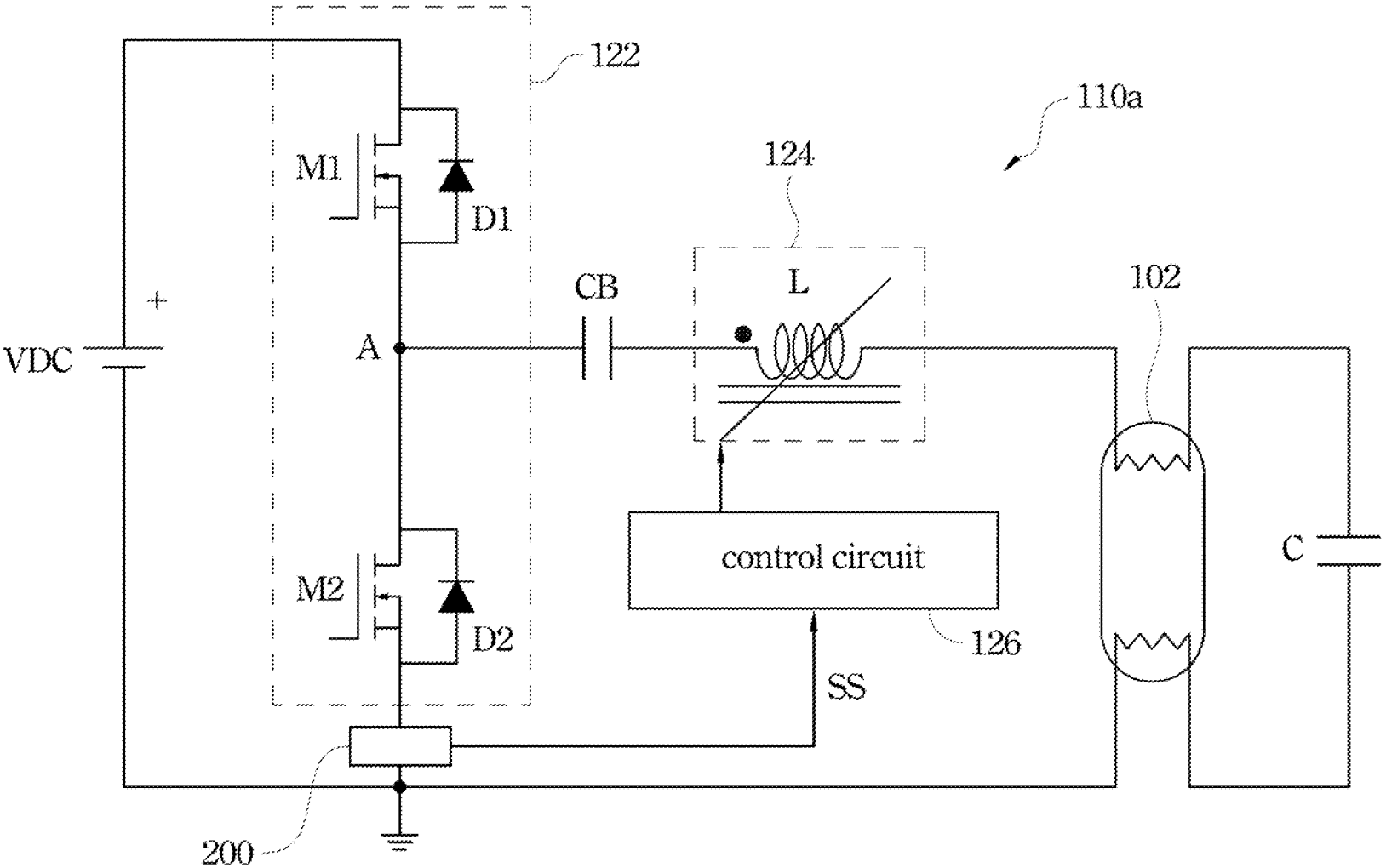
FIG. 3 is a circuit diagram of an illumination apparatus according to another embodiment of the present invention.

FIG. 3 is a circuit diagram of an illumination apparatus according to another embodiment of the present invention. In the present embodiment, the electronic ballast 110*a* may further include a sensing circuit 200. The sensing circuit 200 is electrically coupled to the inverter circuit 122 and configured to transmit the sensing signal SS to the control circuit 126 when the inverter circuit 122 operates under the capacitive mode of operation.

Specifically, the switch devices M1 and M2 are coupled in cascade with the sensing circuit 200. The sensing circuit 200 is configured to detect the current flowing through the switch device M2 in the inverter circuit 122 to generate the sensing signal SS, such that the control circuit 126 regulates the variable inductor unit 124 according to the sensing signal SS.

Notably, the sensing circuit 200 is not limited to being electrically coupled to the switch device M2, and the sensing circuit 200 also can be coupled between the switch devices M1 and M2 or disposed at other positions. In other words, the sensing circuit 200 only needs to be arranged at which the sensing circuit 200 is able to detect current variations in the inverter circuit 122 to further generate the corresponding sensing signal SS.

Figure 4:
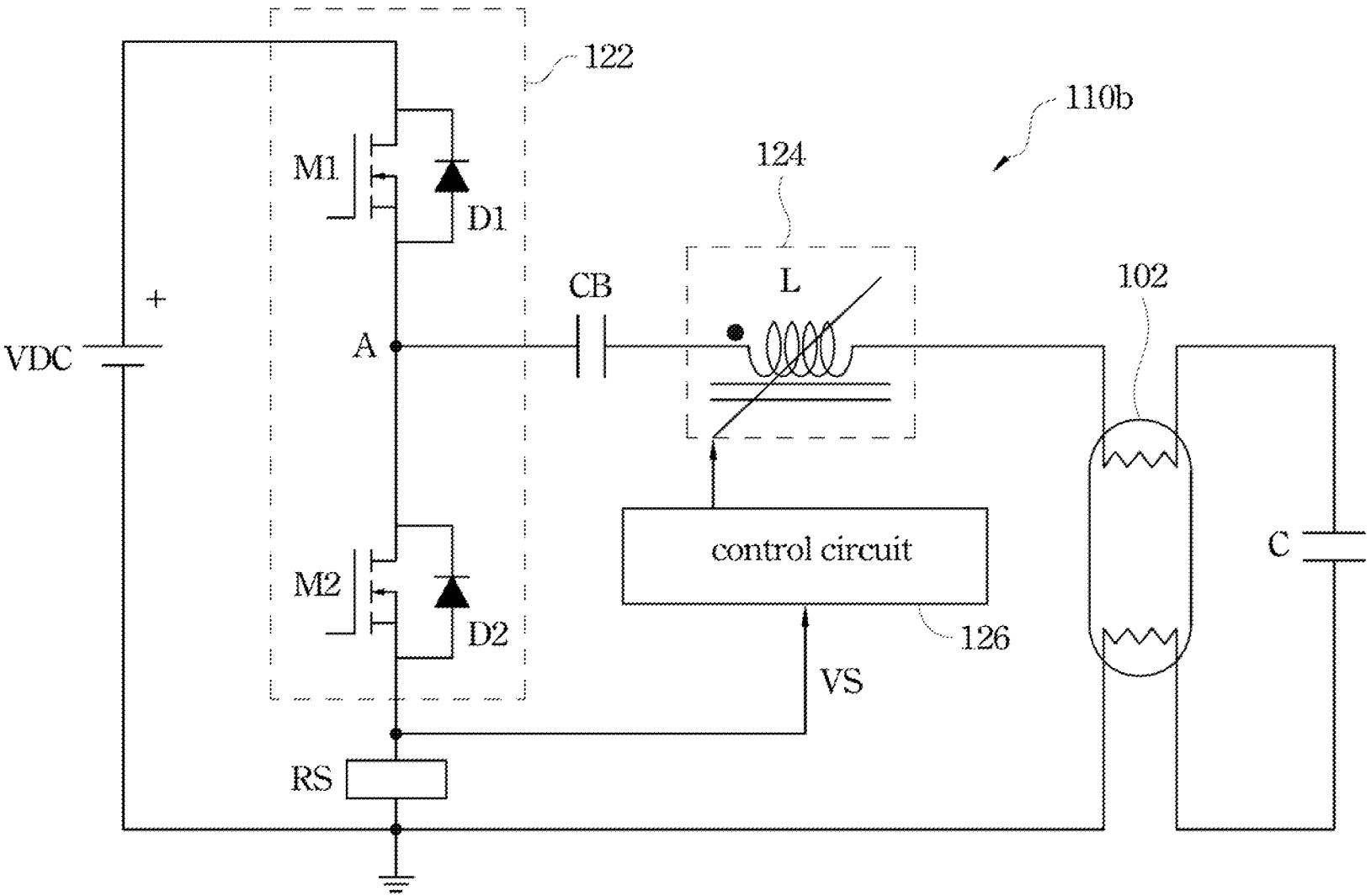
FIG. 4 is a circuit diagram of an illumination apparatus according to yet another embodiment of the present invention.

FIG. 4 is a circuit diagram of an illumination apparatus according to yet another embodiment of the present invention. In the electronic ballast 110*b* of the present embodiment, the sensing circuit 200 may include a sensing resistor RS, in which the sensing resistor RS has one end electrically coupled to the switch device M2 and the control circuit 126 and has the other end electrically coupled to a relatively low level voltage (e.g., a ground voltage GND).

In operation, when the inverter circuit 122 operates under the capacitive mode of operation and the current flows through the switch device M2, the current also flows through the sensing resistor RS, such that the sensing resistor RS generates a sensing voltage signal VS transmitted to the control circuit 126 accordingly.

Similarly, the sensing resistor RS also may be coupled between the switch devices M1 and M2, such that the sensing resistor RS can detect the current flowing through the switch device M2 in the inverter circuit 122 to generate the sensing voltage signal VS when the inverter circuit 122 operates under the capacitive mode of operation. In other words, the sensing resistor RS also can be arranged at other positions and only needs to be arranged at which the sensing resistor RS is able to detect current variations in the inverter circuit 122 to further generate the corresponding sensing voltage signal VS.

Figure 5:
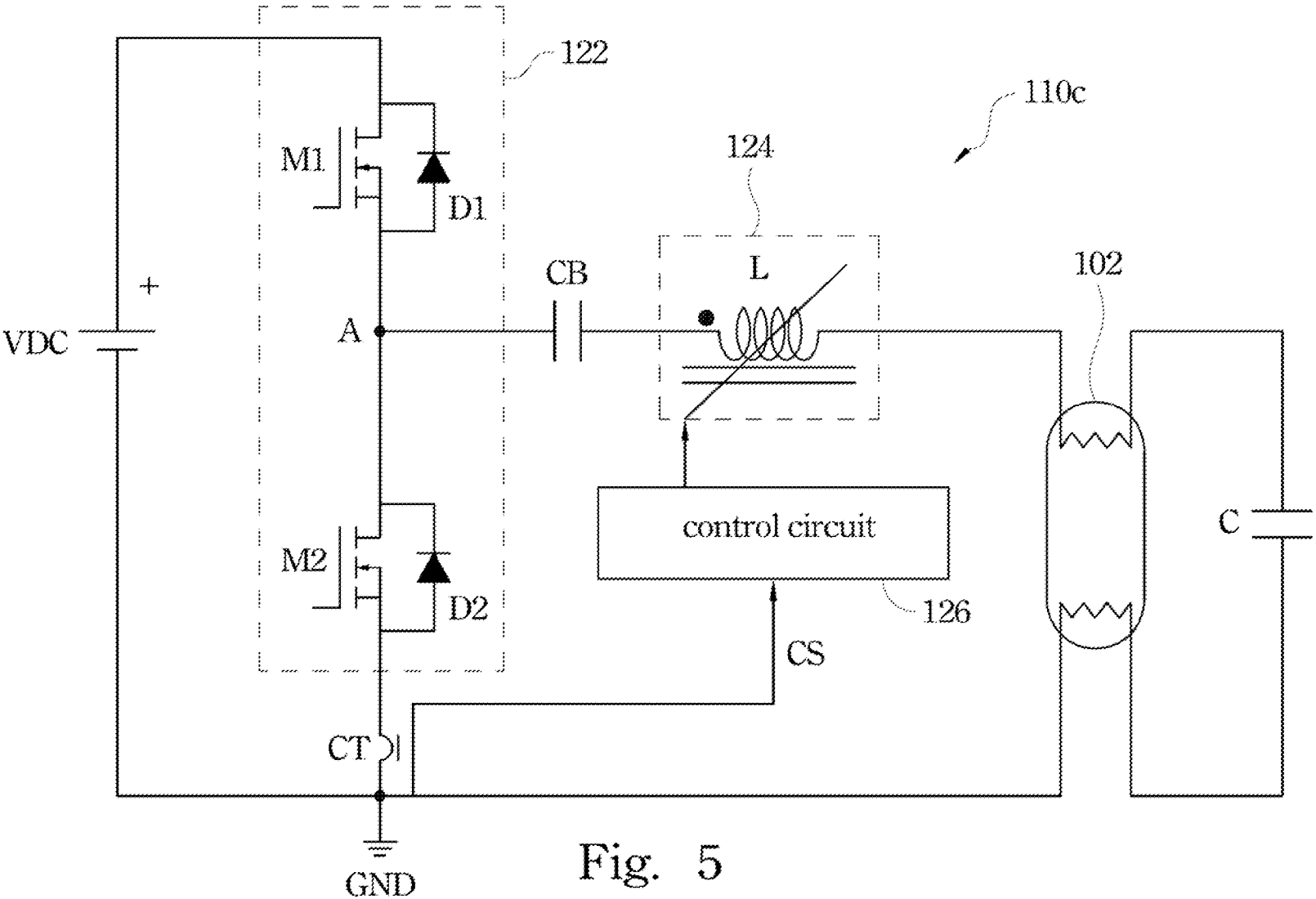
FIG. 5 is a circuit diagram of an illumination apparatus according to still another embodiment of the present invention.

FIG. 5 is a circuit diagram of an illumination apparatus according to still another embodiment of the present invention. In the electronic ballast 110*c* of the present embodiment, the sensing circuit 200 may include a current sensing device CT, in which the current sensing device CT is electrically coupled between the switch device M2 and the control circuit 126.

In operation, when the inverter circuit 122 operates under the capacitive mode of operation and the current flows through the switch device M2, the current also flows through the current sensing device CT, such that the current sensing device CT generates a sensing current signal CS transmitted to the control circuit 126 accordingly.

Similarly, the current sensing device CT also may be coupled between the switch devices M1 and M2, such that the current sensing device CT can detect the current flowing through the switch device M2 in the inverter circuit 122 to generate the sensing current signal CS when the inverter circuit 122 operates under the capacitive mode of operation. In other words, the current sensing device CT also can be arranged at other positions and only needs to be arranged at which the current sensing device CT is able to detect current variations in the inverter circuit 122 to further generate the corresponding sensing current signal CS.

The electronic ballast can be made having one or more of the structures and operations described in the foregoing embodiments. For example, the sensing circuit 200 may include the sensing resistor RS or is only implemented by the sensing resistor RS, while the inverter circuit 122 may be made as a half-bridge inverter circuit or other types of inverter circuits. Therefore, the foregoing embodiments are only for purposes of illustration to describe specific features respectively, all of the embodiments can be selectively made together according to actual requirements, to make the illumination apparatus and the electronic ballast therein described in the present disclosure, and they are not limiting of the present invention.

According to another aspect of the present invention, the embodiment of the present invention described below discloses a method for protecting an electronic ballast, so as to prevent circuits or devices from being burned out or damaged.

Figure 6:
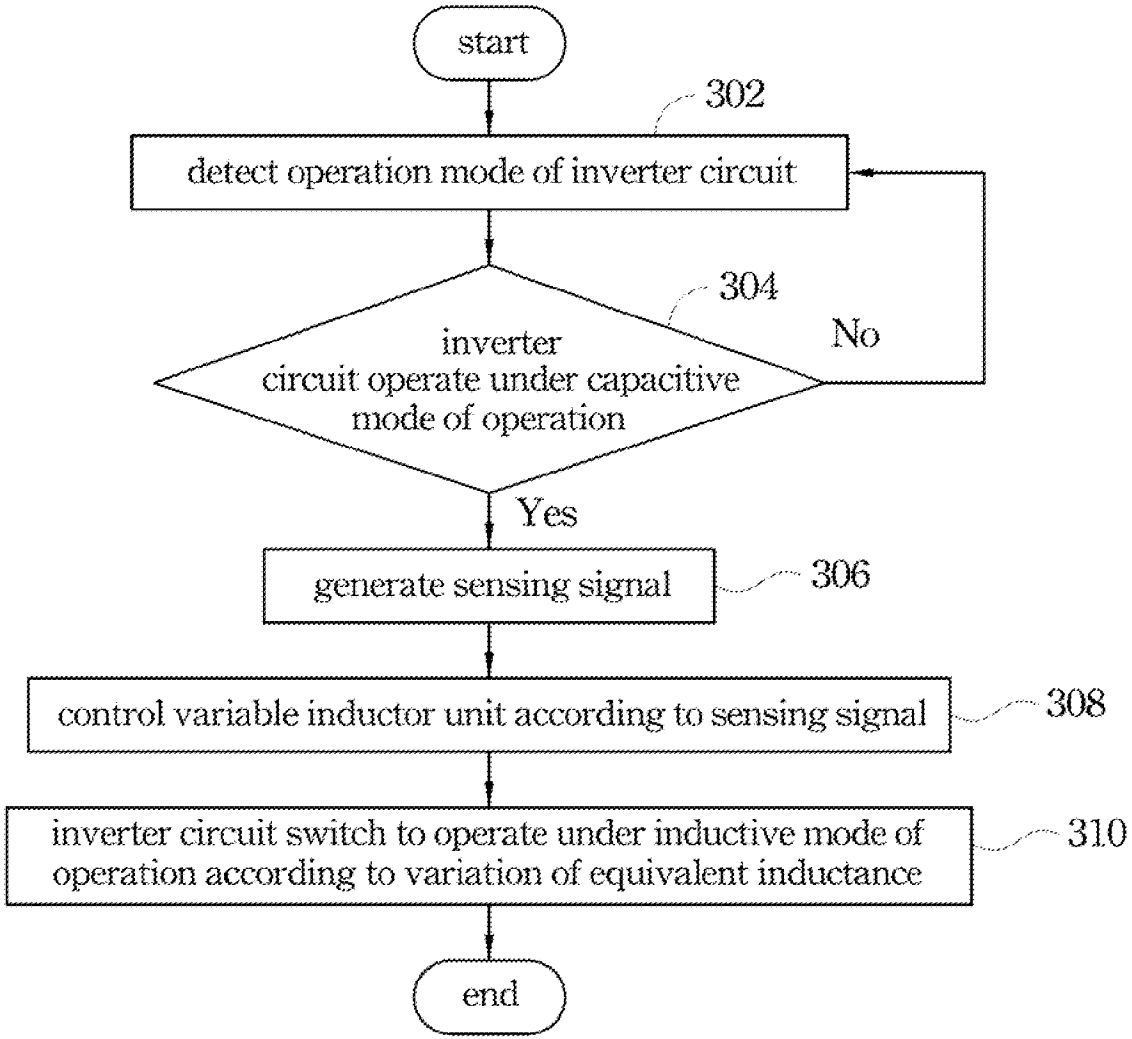
FIG. 6 is a flow chart of a method for protecting an electronic ballast according to one embodiment of the present invention.

FIG. 6 is a flow chart of a method for protecting an electronic ballast according to one embodiment of the present invention. For purposes of clear and convenient illustration, the present embodiment is described while the references to FIG. 1 and FIG. 6 are made at the same time. First, an operation mode of an inverter circuit 122 is detected (operation 302). Then, a determination is made as to whether the inverter circuit 122 operates under the capacitive mode of operation (operation 304). When the inverter circuit 122 does not operate under the capacitive mode of operation, the present operation is maintained and the operation of detecting the operation mode of the inverter circuit 122 continues. On the other hand, when the inverter circuit 122 operates under the capacitive mode of operation, a sensing signal SS is generated (operation 306). Then, the variable inductor unit 124 is controlled according to the sensing signal SS, such that an equivalent inductance of the variable inductor unit 124 has a variation (operation 308). After that, the inverter circuit 122 switches to operate under the inductive mode of operation according to the variation of the equivalent inductance of the variable inductor unit 124 (operation 310).

In one embodiment, the operation 306, where the sensing signal SS is generated, further includes operations described below, in which a current flowing through the switch device M2 in the inverter circuit 122 is detected to generate the sensing signal SS when the inverter circuit 122 operates under the capacitive mode of operation.

In another embodiment, the operation 306, where the sensing signal SS is generated, further includes operations described below, in which current variations (e.g., variations of the current flowing through the switch device M2) in the inverter circuit 122 are detected to generate a sensing voltage signal or a sensing current signal when the inverter circuit 122 operates under the capacitive mode of operation.

In yet another embodiment, the operation 308, where the variable inductor unit is controlled according to the sensing signal SS, further includes operations described below, in which a current flowing through the variable inductor unit 124 is regulated to increase the equivalent inductance of the variable inductor unit 124, for the inverter circuit 122 to switch to operate under the inductive mode of operation according to the variation of the equivalent inductance.

The operations are not recited in the sequence in which the operations are performed. That is, unless the sequence of the operations is expressly indicated, the sequence of the operations is interchangeable, and all or part of the operations may be simultaneously, partially simultaneously, or sequentially performed.

For the foregoing embodiments of the present invention, the embodiments can be applied not only to prevent circuits or devices from being burned out or damaged, to protect the illumination apparatus and the electronic ballast therein, but also to stabilize the electronic ballast and thus improving efficiency of the illumination apparatus.

As is understood by a person skilled in the art, the foregoing embodiments of the present invention are illustrative of the present invention rather than limiting of the present invention. It is intended to cover various modifications and similar arrangements included within the spirit and scope of the appended claims, the scope of which should be accorded with the broadest interpretation so as to encompass all such modifications and similar structures.

What is claimed is:

1. An electronic ballast comprising:

an inverter circuit;

a variable inductor unit electrically coupled between the inverter circuit and an illumination device; and a control circuit configured to control the variable inductor unit according to an operation mode of the inverter circuit such that an equivalent inductance of the variable inductor unit has a variation fed back to the inverter circuit to switch the operation mode of the inverter circuit;

wherein the control circuit regulates the variable inductor unit when the inverter circuit operates under a capacitive mode of operation, such that an equivalent inductance of the variable inductor unit increases and the inverter circuit switches to operate under an inductive mode of operation.

2. The electronic ballast as claimed in claim 1, wherein the control circuit is configured to receive a sensing signal corresponding to current variations in the inverter circuit and to control the variable inductor unit according to the sensing signal.

3. The electronic ballast as claimed in claim 2, further comprising:

a sensing circuit configured to detect the current variations in the inverter circuit to generate the sensing signal and to transmit the sensing signal to the control circuit.

4. The electronic ballast as claimed in claim 3, wherein the sensing circuit comprises a sensing resistor for detecting the current variations in the inverter circuit to generate a sensing voltage signal transmitted to the control circuit.

5. The electronic ballast as claimed in claim 3, wherein the sensing circuit comprises a current sensing device for detecting the current variations in the inverter circuit to generate a sensing current signal transmitted to the control circuit.

6. An electronic ballast comprising:

an inverter circuit comprising a first switch device and a second switch device, the first switch device and the second switch device being coupled at an operation node;

a variable inductor unit having one end electrically coupled to the operation node and having the other end electrically coupled to an illumination device; and a control circuit electrically coupled to the variable inductor unit, the control circuit being configured to regulate the variable inductor unit according to a sensing signal when the inverter circuit operates under a capacitive mode of operation, such that an equivalent inductance of the variable inductor unit increases and the inverter circuit switches to operate under an inductive mode of operation.

7. The electronic ballast as claimed in claim 6, further comprising:

a sensing circuit electrically coupled to the inverter circuit and configured to transmit the sensing signal to the control circuit when the inverter circuit operates under the capacitive mode of operation.

8. The electronic ballast as claimed in claim 7, wherein when the inverter circuit operates under the capacitive mode of operation, the sensing circuit detects a current flowing through the second switch device in the inverter circuit to generate the sensing signal.

9. The electronic ballast as claimed in claim 7, wherein the sensing circuit comprises a sensing resistor having one end electrically coupled to the second switch device and the control circuit and having the other end electrically coupled to a relatively low level voltage.

10. The electronic ballast as claimed in claim 7, wherein the sensing circuit comprises a current sensing device electrically coupled between the second switch device and the control circuit.

11. An illumination apparatus comprising:

an illumination device; and an electronic ballast electrically coupled to the illumination device, the electronic ballast comprising:

an inverter circuit;

a variable inductor unit electrically coupled between the inverter circuit and the illumination device; and a control circuit configured to regulate the variable inductor unit when the inverter circuit operates under a capacitive mode of operation, such that an equivalent inductance of the variable inductor unit increases and the inverter circuit switches to operate under an inductive mode of operation.

12. The illumination apparatus as claimed in claim 11, wherein the inverter circuit further comprises:

a first switch device; and a second switch device, the first switch device and the second switch device being electrically coupled to the variable inductor unit.

13. The illumination apparatus as claimed in claim 12, further comprising:

a sensing circuit coupled in cascade with the first switch device and the second switch device and configured to detect a current flowing through the second switch device in the inverter circuit to generate a sensing signal, the control circuit being configured to regulate the variable inductor unit according to the sensing signal.

14. The illumination apparatus as claimed in claim 12, further comprising:

a sensing resistor coupled in cascade with the first switch device and the second switch device and configured to transmit a sensing voltage signal for driving the control circuit to regulate the variable inductor unit when the inverter circuit operates under the capacitive mode of operation.

15. The illumination apparatus as claimed in claim 12, further comprising:

a current sensing device coupled in cascade with the first switch device and the second switch device and configured to transmit a sensing current signal for driving the control circuit to regulate the variable inductor unit when the inverter circuit operates under the capacitive mode of operation.

16. A method for protecting an electronic ballast, the method comprising:

detecting an operation mode of an inverter circuit;

generating a sensing signal when the inverter circuit operates under a capacitive mode of operation;

controlling a variable inductor unit according to the sensing signal such that an equivalent inductance of the variable inductor unit has a variation; and the inverter circuit switching to operate under an inductive mode of operation according to the variation of the equivalent inductance of the variable inductor unit.

17. The method as claimed in claim 16, wherein the operation of generating the sensing signal further comprises:

detecting a current flowing through a switch device in the inverter circuit to generate the sensing signal when the inverter circuit operates under the capacitive mode of operation.

18. The method as claimed in claim 16, wherein the operation of generating the sensing signal further comprises:

detecting current variations in the inverter circuit to generate a sensing voltage signal or a sensing current signal when the inverter circuit operates under the capacitive mode of operation.

19. The method as claimed in claim 16, wherein the operation of controlling the variable inductor unit further comprises:

regulating a current flowing through the variable inductor unit to increase the equivalent inductance of the variable inductor unit.

* * * * *